US005292098A

United States Patent [19]

Worthington

[11] Patent Number: 5,292,098

[45] Date of Patent: Mar. 8, 1994

[54] SUPPORT WORK PROPS

[75] Inventor: Paul B. Worthington, Chorley, England

[73] Assignee: Thos. Storey (Engineers) Limited, United Kingdom

[21] Appl. No.: 844,953

[22] Filed: Feb. 28, 1992

Related U.S. Application Data

[63] Continuation of Ser. No. 634,463, Dec. 27, 1990, abandoned, which is a continuation of Ser. No. 420,176, Oct. 12, 1989, abandoned.

[51] Int. Cl.[5] ..... E04G 25/00

[52] U.S. Cl. ..... 248/354.1; 52/127.2; 248/354.3; 248/354.7

[58] Field of Search ..... 248/244, 245, 250, 351, 248/354.1, 354.3, 357; 52/127.2, 726, 729

[56] References Cited

U.S. PATENT DOCUMENTS 2,086,009 7/1937 Walker ..... 52/726 X
3,228,646 1/1966 Hinrichs et al. ..... 248/354.3

FOREIGN PATENT DOCUMENTS 676583 7/1952 United Kingdom ..... 248/357

*Primary Examiner*—David A. Scherbel
*Assistant Examiner*—Derek J. Berger
*Attorney, Agent, or Firm*—Wood, Herron & Evans

[57] ABSTRACT

A support work prop is described which has a main body section formed from interconnected aligned soldiers. Head and base sections are provided for interconnecting the upper and lower ends of the soldiers which may themselves be connected to either screws or jacking members, header beams or bearing plates. The prop can be readily disassembled to allow the soldiers to be employed separately so that the arrangement allows them to have a dual purpose.

15 Claims, 4 Drawing Sheets

SUPPORT WORK PROPS

This application is a continuation of application Ser. No. 07/634,463, filed Dec. 27, 1990, now abandoned, which is a continuation of application Ser. No. 07/420,176, filed Oct. 12, 1989, now abandoned.

This invention relates to a support work props.

Known props have been designed to have a single function, that is, they act only as a prop In co-pending GB Patent Application No. 8626060 a support work prop is described which has a main body section comprising a plurality of elongated support members and connecting means to secure together the support members. The support members, which are preferably reinforcing chords used in panel bridges, therefore have dual applications. By providing props whose components can be used in other applications equipment costs are reduced.

However, props formed from bridge reinforcing chords are relatively heavy and their load bearing capacity is greater than is required in certain propping situations.

In accordance with the invention a support work prop has a main body section comprising a plurality of soldiers and connecting means to secure the soldiers together.

The support work prop includes soldiers which have very good strength to weight ratios and the props are, therefore, lighter than those which comprise I-beam channel sections. The soldiers can moreover be disconnected and employed separately when necessary Preferably a prop has a head section to connect the upper ends of the soldiers and a base section to connect the lower ends of the soldiers.

The head and/or base section may comprise a flat plate with a number of holes by means of which the soldiers are attached. Alternatively, the head and/or base section may comprise a plate having a number of holes by means of which the ends of the soldiers are attached and a housing member for an adjustable screw or jacking member. The adjustable screw or jacking member may be pivotally connected at its outer end to a flat plate Suitably the pivotally connected flat plate is adapted to be connected to one or more header beams.

The main body section of the prop may comprise two or more sub-sections each sub section having a plurality of soldiers secured together by connecting means, the soldiers of each sub-section being attached to the soldiers of the adjacent sub section(s). The term 'soldier' as used herein refers to a component comprising a pair of spaced parallel beams connected at top and bottom by tie plates and having a number of aligned openings in the beams. These components are also known as 'shoring components', 'framework elements' and 'propping components'.

The invention will now be further described by way of example with reference to the accompanying drawings to which:

FIG. 1 is a side view of a vertical propping arrangement incorporating a number of props in accordance with the invention;

FIG. 2. is a side view of a first horizontal propping arrangement using a prop in accordance with the invention.

Figure 1:
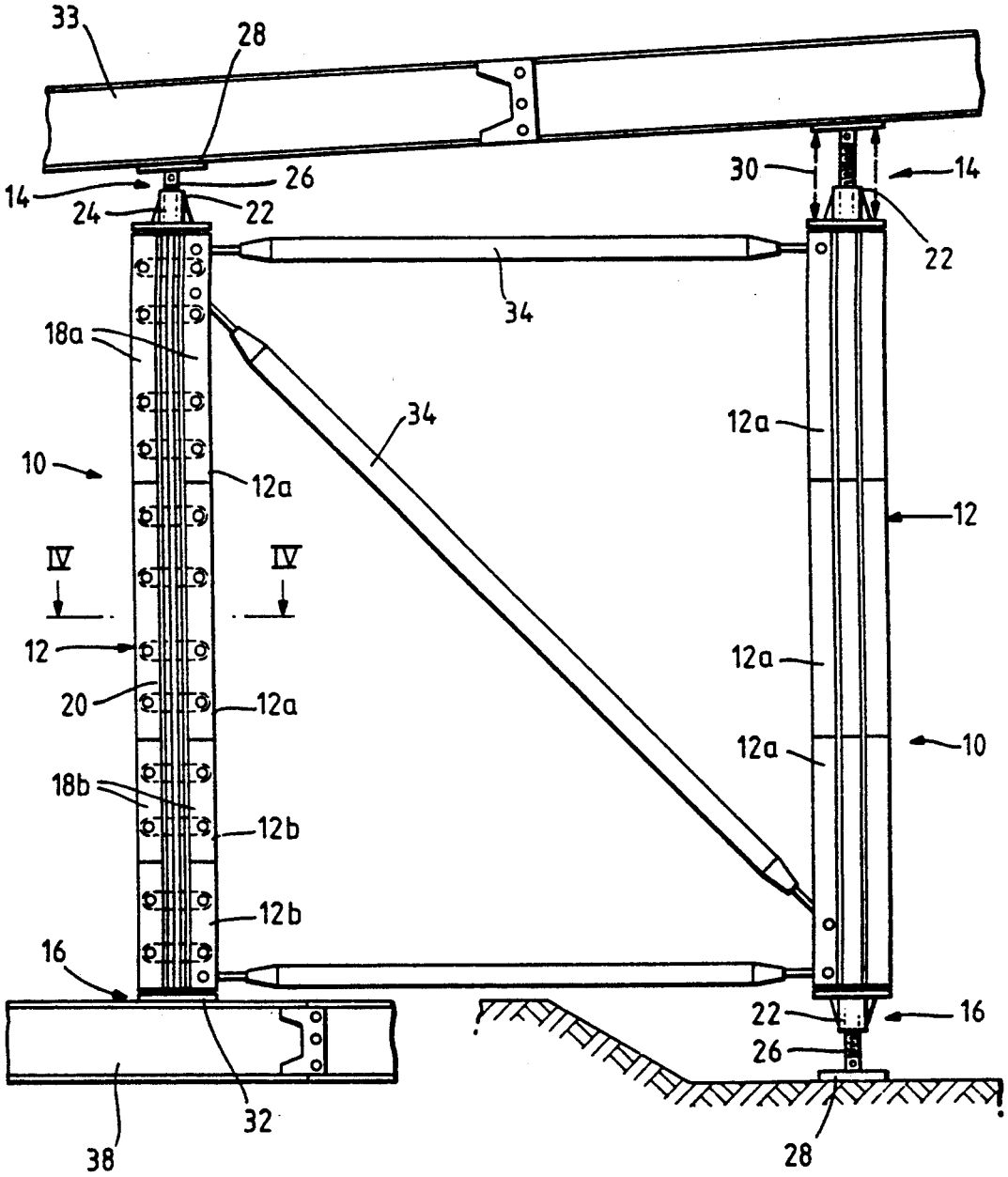

In FIG. 1, two props 10 are shown having a main body section 12, a head section 14 and a base section 16. The main body section 12 of each prop is composed of sub-sections **12*a* and 12*b*. The right-hand prop 10 comprises three sub-sections 12*a* each of which comprises four soldiers 18*a* removably secured to two connectors 20 (see FIGS. 4 and 5). The left hand prop 10 comprises two sub-sections 12*a* and two sub-sections 12*b*. The sub sections 12*b* comprises four shorter soldiers 18*b* removably secured to connectors 20. The head sections 14 of the props 10 shown in FIG. 1 each have a prop head 22 (see FIGS. 7 and 8) secured to the soldiers 18 which includes a housing member 24. The inner end of an adjustable screw 26 is inserted into the housing member 24 of each of the prop heads 22, the screws 26 being rotatably movable relative to the prop head 22. At the other end of the adjustable screws 26 a plate 28** is pivotally attached.

On the right hand prop 10 of FIG. 1 a hydraulic jack (not shown) is attached to the prop head 22. The hydraulic jack can be employed to pre-load the prop or for jacking up. The movement of the jack is shown by dotted lines 30.

The base section 16 of the left-hand prop 10 of FIG. 1 comprises a prop base plate 32 (see FIGS. 9 and 10) secured to the bottom ends of the four soldiers **18*b*. The base-section of the right-hand prop has a prop head 22, in the housing member 24 of which an adjustable screw 26 is inserted. A plate 28** is attached to the other end of the screw.

The two props 10 of FIG. 1 are connected together by bracing members 34. The bracing members may be adjustable push pull props or structural sections. The head sections of the props 10 support I-shaped header beams 38 of the type described in co-pending application Ser. No. 8,626,060 the cross fall of which is taken up by the adjustable screw 26, hydraulic jack 30 and pivoting plates 28. The left-hand prop 10 is supported via prop base plate 32 on further header beams 38 while the right-hand prop 10 rests on the ground. Instead of the adjustable screw 26 of the base-section of the right-hand prop a hydraulic jack could be employed so that jacking can be done from the bottom of the prop.

Figure 2:
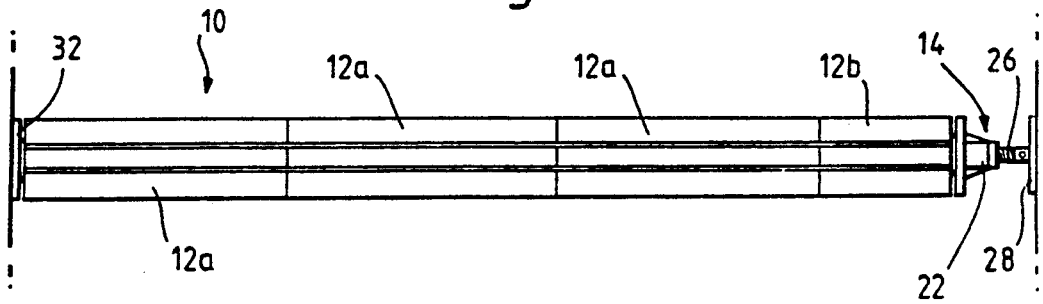
Figure 3:
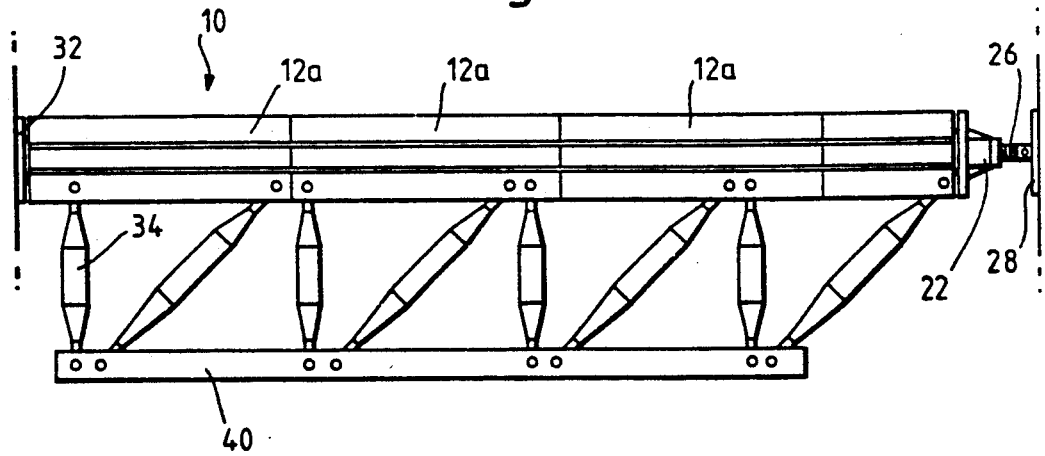
FIG. 3 is a side view of a second horizontal propping arrangement.

FIG. 2 and 3 show the props 10 in horizontal propping arrangements. The main body section 12 of the prop 10 or FIG. 2 comprises three subsections **12*a* and one sub-section 12*b*. At the left-hand end a prop base plate 32 is secured to the four soldiers 18*a* of the left-hand sub section 12*a* whilst at the right-hand end a prop head 22, adjustable screw 26 and pivot plate 28** as described above are employed.

The arrangement of FIG. 3 is similar to that of FIG. 2 except that a section 40 is connected to the prop 10 by bracing members 34. The section 40 may be formed from soldiers, push-pull or shoring components or standard structural sections. The arrangement prevents undue deflection of the prop 10 by reducing self-weight bending and allows the prop to be employed over long horizontal distances.

Figure 4:
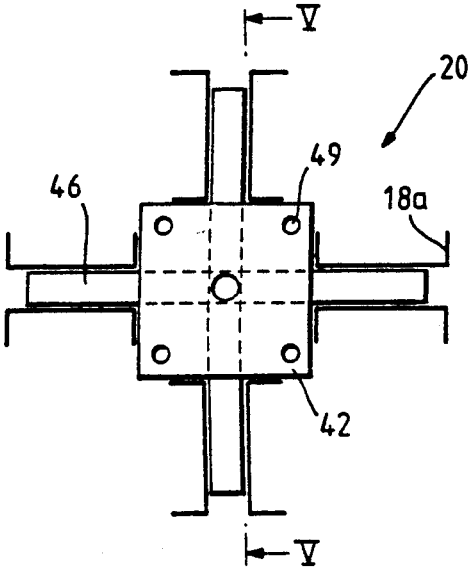
FIG. 4 is a sectional view in the direction of arrows IV IV of FIG. 1 and shows the connecting means of the props of FIG. 1 to 3.
Figure 5:
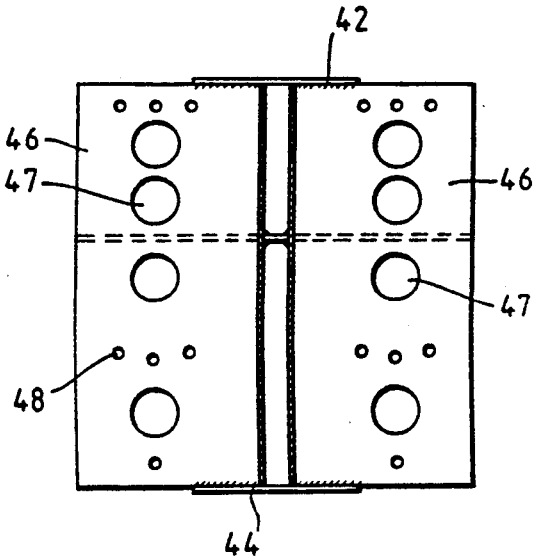
FIG. 5 is a cross-sectional view of the connecting means of FIG. 4 as taken in the direction of arrows V V if FIG. 4.

In FIGS. 4 and 5, the connector 20 is shown in greater detail. It comprises on upper end plate 42 and a lower end plate 44 joined together by four rectangular connecting members 46 which are welded to the plates 42 and 44. Each connecting member 46 is so dimensioned that it can be inserted between the parallel webs of a soldier 18*a* or 18*b*. The soldier 18*a* or 18*b* is then secured to the connecting member 46 by bolting them together through holes in the soldier 18*c* or 18*b* and connecting member 48 The connecting members 48 are preferably provided with a series of holes 47 so that they may be employed with different soldier designs. Alternatively adaptors (not shown) could be provided to secure the soldiers to the connecting members, holes 48 being provided on the connecting members whereby the adaptors can be secured thereto. Again a number of differently positioned adaptor connection holes are preferably provided to allow the connector to be used with different soldier designs. The connector 20 is also provided with a hole 49 at each corner to which bracing members can be attached.

Figure 6:
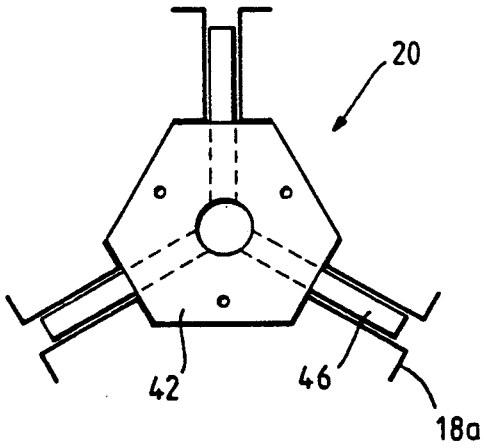
FIG. 6 is a similar view to FIG. 4 showing an alternative form of connecting means.

FIG. 6 shows an alternative form of connector similar to that described above except that three connecting members are provided so that three soldiers can be connected at 120° from each other.

Figure 7:
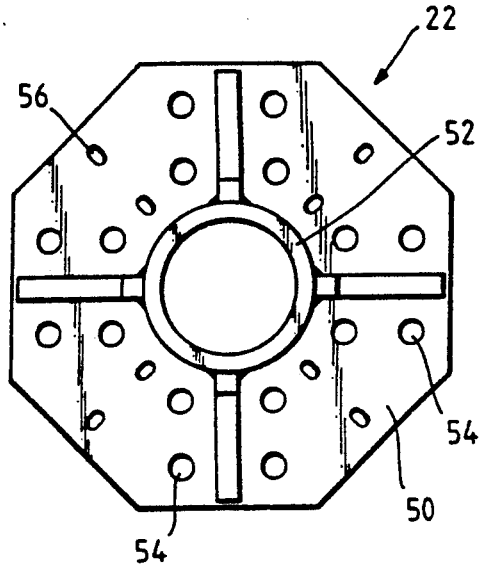
FIG. 7 is a plan view of the head section of the props of FIG. 1.
Figure 8:
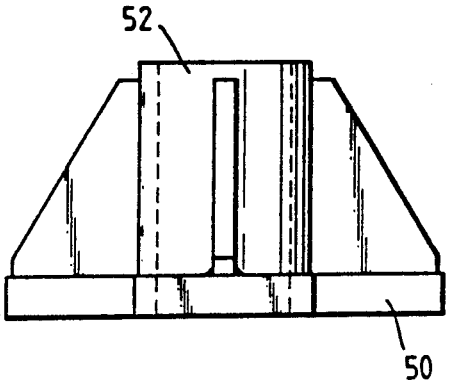
FIG. 8 is a side view of the head section of FIG. 7.

The prop head 22 is shown in FIGS. 7 and 8 and has a plate 50 which supports a central tube 52 which is treaded to receive the inner end of an adjustable screw 26. The plate 50 has holes 54 suitably positioned so that the ends of the soldiers 18*a* or 18*b* may be secured to the prop head 22 by means of bolts which are passed through the holes 54 and correspondingly positioned holes in the end plates of the soldiers 18*a* or 18*b*. The plate 50 is also provided with slots 56 positioned between the holes 54 for bolting down hydraulic jacks or packing stools (not shown).

Figure 9:
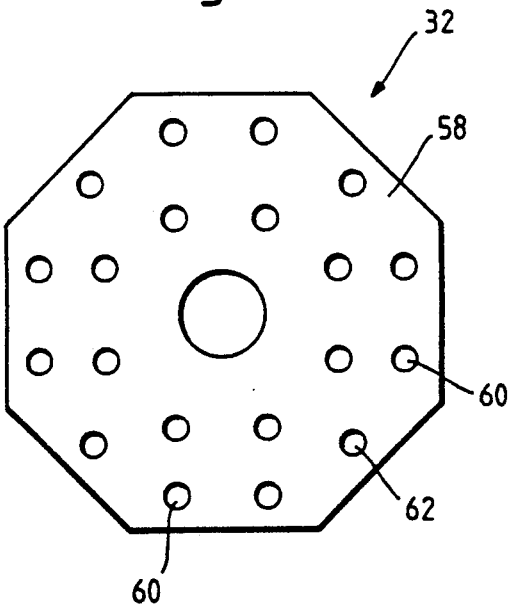
FIG. 9 is a plan view of base section of the props of FIG. 1.
Figure 10:
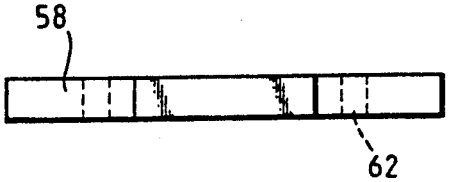
FIG. 10 is a side view of the base section of FIG. 9.

The prop base plate 32 is shown in FIGS. 9 and 10 and comprises a flat plate 58 with attachment holes 60 for securing the plate to the ends of the soldiers 18*a* or 18*b*. Four additional holes 62 are positioned between the sets of attachment holes 60.

The props may be used as vertical supports within falsework schemes to carry loads arising from in-situ or pre-cast construction, to support bridge decks while repairs are carried out, backpropping to newly constructed slabs, temporary underpinning of existing structures and for heavy lifting schemes. As horizontal struts, the prop is ideal for use in large sheet pile or diaphragm wall cofferdams.

The prop can also be used as a raking prop to support existing structures during alterations, temporary supports to pre-cast units and support to single sided sheet pile walls.

Within the head of the prop, there are provisions for preloading or jacking up and releasing of structures using hydraulic jacks without the need for subsidiary packing or support.

The props may be braced as shown in FIGS. 1 and 3, the bracing members being attached either through holes in the soldiers as shown or by means of the holes 48 in the upper and/or lower plates 42 and 44 of the connector 20. The bracing connection holes are so arranged that bracing can be provided between the props 10 and the props described in co-pending G.B. Patent Application No. 8626060 so that, when required both types of props can be employed in the same propping arrangement.

I claim:

1. A support work propr comprising:

a plurality of soldier members, each said soldier member comprising first and second beams and tie plates, each of said beams having a top and a bottom end, a top one of said tie plates being connected to the top ends of the first and second beams and a bottom one of said tie plates being connected to the bottom ends of the first and second beams to hold the beam parallel one to the other and spaced one from the other, the first and second beams defining at least two apertures therein, the apertures of the first beam being aligned with those of the second beam;

connecting means that releasably secure said soldier members together intermediate their top and bottom ends to form a main body section in which said soldier members are oriented parallel one to the other said connecting means being attached to each of said soldier members by way of the at least one pair of aligned apertures therein;

a head section comprising a head plate that releasably secures the top ends of said soldier members together; and a base section comprising a base plate that releasably secures the bottom ends of said soldier members together, whereby said support work prop is dismountable into its component parts.

2. A support work prop as claimed in claim 1, said top tie plates connected to the top ends of said soldier members having a plurality of holes formed therein and said heat plate being formed with a plurality of holes, the top ends of said solider members being secured to said head plate by bolting through the holes in said head plate and the holes in said top tie plates.

3. A support work prop as claimed in claim 1, said bottom tie plates connected to the bottom ends of said solider members having a plurality of holes formed therein, and said base plate being formed with a plurality of holes, the bottom ends of said solider members being secured to said base plate by bolting through the holes in said base plate and the holes in said bottom tie plates.

4. A support work prop as claimed in claim 1 wherein the head section and/or the base section includes a member for connecting the section to one end of either an adjustable screw or a jaking member.

5. A support work prop as claimed in claim 4, said prop comprising a connecting member, one of an adjustable screw and a jacking member connected at one end thereof to the head section via said connecting member and a flat plate pivotally connected to the other end of said one of said adjustable screw and said jacking member.

6. A support work prop as claimed in claim 5, said prop comprising a header beam connected to said pivotally connected flat plate.

7. A support work prop as claimed in claim 4, said prop comprising a connecting member, one of an adjustable screw and a jacking member connected at one end thereof to the base section via said connecting member and a flat plate pivotally interconnected to the other end of said one of said adjustable screw and jacking member.

8. A support work prop as claimed in claim 1 wherein the connecting means comprises two plates connected and spaced by a plurality of connecting members, the number of which is equal to the number of soldiers to be interconnected.

9. A support work prop as claimed in claim 8 wherein the connecting members are formed with holes whereby they may be bolted to the soldier members.

10. A support work prop as claimed in claim 1 wherein the connecting means include attachment points for bracing members.

11. A support work prop as claimed in claim 1 wherein the head section includes attachment points for bracing members.

12. A support work prop as claimed in claim 1 wherein the base section includes attachment points for bracing members.

13. A support work prop comprising:

a plurality of solider members, each said solider member comprising first and second beams and tie plates, each of said beams having a top and bottom end, a top one of said tie plates being connected to the top ends of the first and second beams and a bottom one of said tie plates being connected to the bottom ends of the first and second beams to hold the beams parallel one to the other spaced one from the other, the first and second beams defining at least two apertures therein, the apertures of the first beam being aligned with those of the second beam;

connecting means that releasably secure said soldier members together intermediate their top and bottom ends to form a main body section, said main body section comprising at least a first subsection and a second subsection, each subsection including a plurality of soldier members releasably secured intermediate their top and bottom ends by said connecting means such that the soldier members are radially spaced around a center axis, the soldier members being parallel one to the other and to the center axis;

said connecting means being attached to each of said soldier members by way of the at least one pair of aligned apertures therein;

a head section comprising a head plate that releasably secures the top ends of said soldier members of said first subsection together; and a base section comprising a base plate that releasably secures the bottom ends of said soldier members of said second subsection together, said bottom ends of said soldier members of said first subsection being releasably secured to the top ends of said soldier members of said second subsection with the center axes of the sections aligned, whereby said support work prop is dismantable into its component parts.

14. A support work prop as claimed in claim 13, said prop comprising:

at least one intermediate subsection positioned between, and with its center axis aligned with, the other subsections, the top ends of said soldier members of said intermediate subsection being releasably connected to the bottom ends of said soldier members of an adjacent subsection and the bottom ends of said soldier members of said intermediate subsection being releasably connected to said top ends of said soldier members of an adjacent subsection.

15. A support work prop as claimed in claim 13, wherein said attachment means comprises bolts for bolting the top tie plate of one subsection to the bottom tie plate of an adjacent subsection.

* * * * *